United States Patent [19]

Jacobsen et al.

[11] 4,436,034

[45] Mar. 13, 1984

[54] SMOKE GRENADE WITH SUCCESSIVE SLOW AND FAST BURNING CHARGES

[75] Inventors: Kjell O. Jacobsen, Raufoss; Tore Matre, Østerås; Rolf I. Halvorsen, Bøverbru; Ingar H. Heie, Raufoss; Erling Myhrvold, Raufoss; Ove R. Berger, Raufoss, all of Norway

[73] Assignee: A/S Raufoss Ammunisjonsfabrikker, Raufoss, Norway

[21] Appl. No.: 260,827

[22] Filed: May 5, 1981

[51] Int. Cl.[3] ..... C06D 3/00

[52] U.S. Cl. ..... 102/334; 102/487; 102/202.13; 102/275.3

[58] Field of Search ..... 102/334, 487, 473, 367, 102/370, 202.13, 275.13

[56] References Cited

U.S. PATENT DOCUMENTS

| | | | |
|---|---|---|---|
| 2,115,047 | 4/1938 | Stevenson | 102/334 X |
| 2,789,467 | 4/1957 | Rosenthal | 102/334 X |
| 3,372,641 | 3/1968 | Foster | 102/334 |
| 3,537,397 | 11/1970 | Ripley et al. | 102/334 X |
| 4,220,091 | 9/1980 | Israels et al. | 102/487 |
| 4,324,183 | 4/1982 | Prahauser et al. | 102/487 X |
| 4,353,301 | 10/1982 | Jacobsen | 102/334 |

FOREIGN PATENT DOCUMENTS

| | | | |
|---|---|---|---|
| 885423 | 1/1981 | Belgium | 102/334 |
| 2308899 | 12/1976 | France | 102/334 |
| 2076945 | 9/1981 | United Kingdom | 102/334 |

*Primary Examiner*—Peter A. Nelson
*Attorney, Agent, or Firm*—Larson and Taylor

[57] ABSTRACT

A smoke shell for providing successive ignition of slow burning and fast burning smoke emitting charges. A steel shell containing a slow burning charge is ejected in a delayed time period after an inner casing with its upper fast burning charge has been ejected.

2 Claims, 3 Drawing Figures

SMOKE GRENADE WITH SUCCESSIVE SLOW AND FAST BURNING CHARGES

The present invention relates to a smoke shell for emitting a rapid burning and a slow burning charge.

In combat it is most important to be able to make own vehicles invisible against enemy fire. This can be achieved in various manners, and one method is to screen own vehicles by arranging a smoke screen in the surroundings between the enemy fire and own vehicles.

Smoke can be applied to the desired area in various manners, smoke charges can for instance be fired and ignited in the area to be smoke screened.

It will often be of interest both to establish a smoke screen very rapidly and to maintain the screening effect for a longer period of time.

A device which solves this problem is a smoke shell as described in the Norwegian Patent Application No. 78 0818. Said smoke shell comprises a smoke charge consisting of at least two smoke emitting partial charges having different reaction rates and/or smoke emitting rates. They are simultaneously ejected by an expelling charge and are initiated by a bursting igniting charge. According to said invention delayed-action igniter means are provided between said partial charges for stepped initiation. According to a special embodiment the instantaneous smoke member comprises superimposed, disc-shaped smoke elements arranged around said bursting/igniting charge in the lower portion of said smoke shell and this is succeeded by a delayed-action initiation transmission for an initiation charge that is surrounded by a smoke generator for slower smoke emission in the upper portion of said smoke shell.

A deficiency of said solution of the problem can be that the instantaneous smoke and the slowly emitted smoke are both emitted in the same area.

Another disadvantage of the known smoke shell is that the burning surface of the smoke generator charge is in direct contact with the ground, which may be snow-covered or wet. This can have an advers effect on the smoke development.

A further disadvantage of the known smoke shell is that the smoke generator will have an arbitrary direction after bursting. This may cause an undesired distribution of the smoke generator when several shells are fired at the same time.

The transmission to the initiating charge of the smoke generator is initiated at the moment of explosion. Thus, the smoke generator is initiated after the establishment of the instantaneous smoke. When the weather conditions are unfavorable there could be a delay between the instantaneous smoke screen and the smoke generator.

According to the present invention these problems are solved by a smoke shell comprising an upper rapid burning instantaneous member having an igniting-/bursting charge and a separate expelling charge as well as a lower slow burning smoke generator provided in a steel box and having a separate ejector charge and a common igniter means.

Said smoke shell is preferably dimensioned so as to be fired by firing means e.g. of a Leopard tank.

With such a firing means the igniter means is a electrical squib.

In case of emergency said shell can also be thrown by hand. In that case the igniter means is an impact fuse.

Advantageously the instantaneous member is bursted approx. 0.8 seconds after firing. The slow burning member, however, will have a burning time of 60–180 seconds.

The slow burning smoke generator will be fired in its steel box which, after having passed its orbit will lie upside down, so that said smoke generator lies in said box with its bottom turned down and its top free, so as to be protected against a wet ground and snow.

When the smoke shell is fired from a tank or another vehicle the instantaneous smoke member will ejected so that the center of the developed smoke screen will be approx. 10–20 meters from the firing point, whereas the center of the developed smoke generator will be approx. 30–70 meters from the firing point.

The distance from the firing point to the bursting point of the instantaneous smoke member depends on the relation between the force of the expelling charge and the burning time of the delay member. This can also be varied by the firing angle.

The distance of the firing point to the impact area of the smoke generator depends on the force of the expelling charge and said firing angle.

A detailed description of the construction of the smoke shell and its function follows with reference to the attached schematic drawing.

For clarity the disclosed smoke shell may be arranged in four main parts:

An instantaneous smoke member
A smoke generator
A contact head
An ignition transmitter

The instantaneous smoke member

Figure 1:
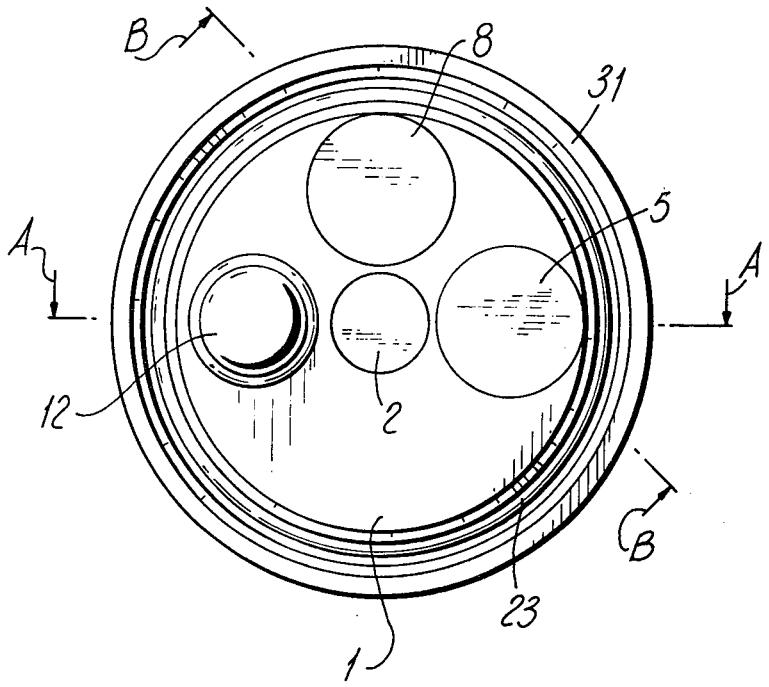
FIG. 1 shows a 76 mm smoke shell, seen from the bottom side.
Figure 2:
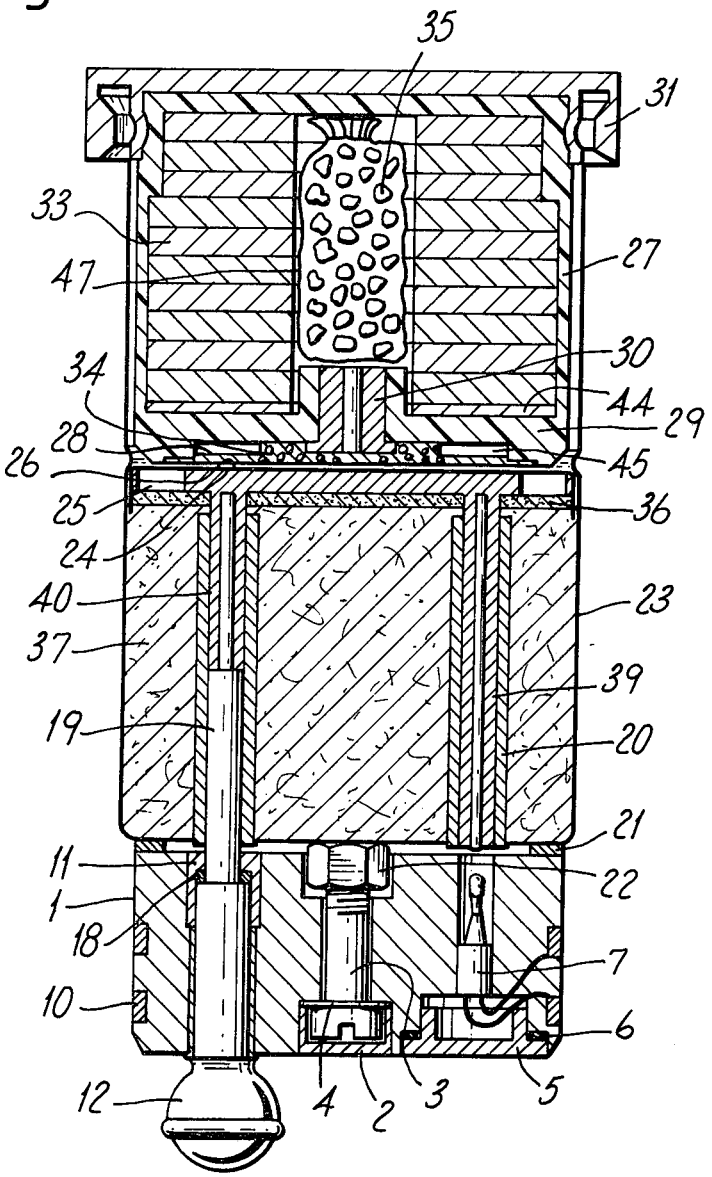
FIG. 2 is a section A—A of said shell and FIG. 3 is a section B—B.

With reference to FIG. 2, the instantaneous smoke member comprises a plastic box 27 and a cover 29. Instantaneous smoke discs 33 having a bore are arranged in said box. In the central bore an igniting/bursting charge 35 is provided.

In the bottom of said box 27 a delay element 30 and an ejector charge 34 are provided.

The smoke generator member

A smoke-charge 37 is arranged pressed into an all-drawn steel box 23. Said box 23 is the outer projectile shell.

On the surface turned up of the smoke-charge 37 an initiating charge 36 is provided.

The smoke generator-member and the instantaneous smoke member are separated by an intermediate cover 24 provided with an opening 25 (see FIG. 2).

The contact head

Figure 3:
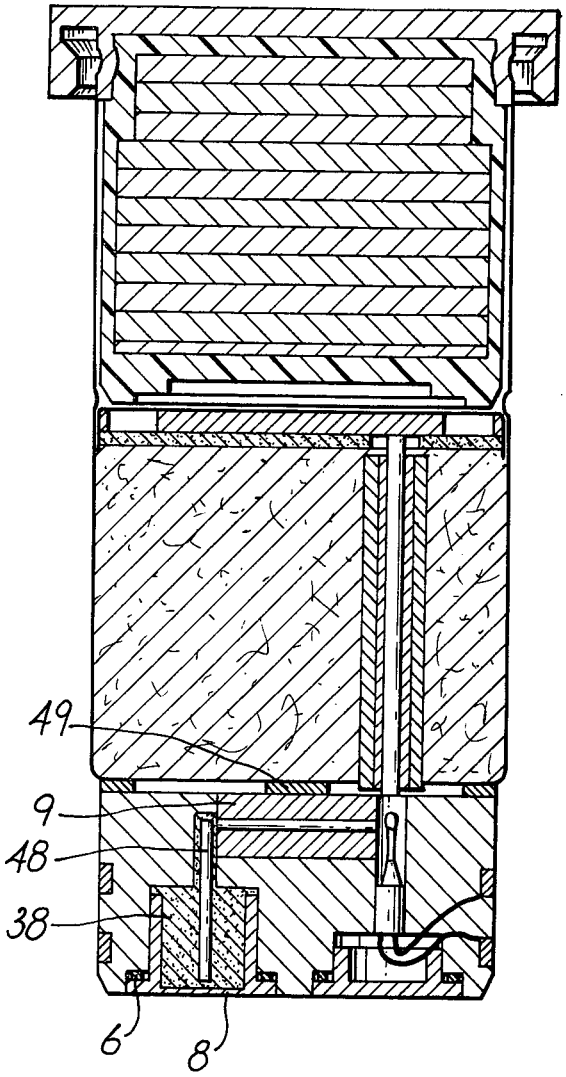

A contact head 1 is provided as the lower portion of said shell for transmission of the initiation to the smoke members. An electric puls is transmitted by contact rings 10. FIG. 3 shows the ejector charge 38 for the entire shell, which is provided in the contact head, and a transmission 9 from a squib 7. The relative arrangement of said members will appear from FIG. 3.

An impact igniter 12 with a delay 19 is provided for throwing said shell by hand.

The ignition transmission

The ignition transmission from the contact head to the smoke member is achieved via two channels 20, one for initiation by squib and one for manual triggering. The transmission is achieved by a stooping fuse (open black powder fuse) 39 and 40.

Further details of the shell will appear from the remaining reference numbers in connection with the accompanying explanation of reference numbers.

Now, the function of the smoke shell will be explained.

Initiation by a squib

An electrical pulse through said contact rings 10 ignites said squib 7, which in turn ignites the transmission 39. This will burn rapidly (50–100 m/sec.) and initiate an ejector charge 34 in the instantaneous smoke box 27. Simultaneously the initiating charge 36 for said HC-charge 37 is also initiated.

Thus, the instantaneous smoke box is ejected. The delay means 30 is ignited and burns for approx. 0,8 seconds. Said burning time can, however, be varied according to desirability and requirements. Then said box is burst by bursting charge 35 and an instantaneous smoke screen is developed.

After a delay of 0,5–2 seconds in relation to the ejection of said instantaneous smoke box said smoke generator box is ejected. The smoke charge is then initiated and provides full smoke development as it hits the ground. The total smoke emission time of the smoke charge can vary from 60 to 180 seconds.

The instantaneous smoke charge is burst at a distance of approx. 10 meters from the firing location. The smoke generator is on the other hand established at a distance of 40 to 50 meters from the firing location.

Triggering by hand

When the smoke shell is triggered by hand the ignition is initiated by an impact igniter 12. The shell is thrown and after the above mentioned delay the instantaneous smoke member is ejected and burst at the same time as the smoke generator charge is initiated.

This subsidiary initiation and throwing is preferably only used in cases of emergency.

The inventive idea appears from the above description and is illustrated by way of example in the drawing and the scope of the invention will appear from the following claim.

We claim:

1. A smoke shell for successively discharging a fast burning smoke emitting charge and a slow burning smoke emitting charge comprising a steel casing, an inner casing positioned in the upper part of the said steel casing and enclosing an upper instantaneous fast burning smoke emitting charge in the form of a series of annular disc rings, and an ignition bursting charge disposed in the central lower end of the steel casing ignition means for igniting said bursting charge, a first stooping fuse in the lower part of the steel casing leading from the ignition means and extending upwardly through said slow burning charge, an ejector charge a delay charge for controlling the ignition of the ejector charge for the instantaneous fast burning charge, a second delay charge disposed in the inner casing for igniting the ignition bursting charge for the instantaneous fast burning charge, a third delay charge and a second stooping fuse disposed in a contact head leading from the ignition means to the ejector charge for ejecting the said shell with its slow burning charge, the delay time of the first stooping fuse from the ignition means up to the perforated cover being shorter than the combined burning times of the third delay charge and of the second stooping fuse together, which lead from the ignition means to the ejector charge, for ejecting the steel shell with its slow burning charge in a delayed time period after the inner casing with its fast burning charge has been ejected.

2. A smoke shell as defined in claim 1 said inner casing being of plastic.

* * * * *